US005243123A

United States Patent [19]

Chaya

[11] Patent Number: 5,243,123

[45] Date of Patent: Sep. 7, 1993

[54] MUSIC REPRODUCING DEVICE CAPABLE OF REPRODUCING INSTRUMENTAL SOUND AND VOCAL SOUND

[75] Inventor: Norio Chaya, Nagoya, Japan

[73] Assignee: Brother Kogyo Kabushiki Kaisha, Nagoya, Japan

[21] Appl. No.: 762,509

[22] Filed: Sep. 19, 1991

[30] Foreign Application Priority Data

Sep. 19, 1990 [JP] Japan ..... 2-250533

[51] Int. Cl.[5] ..... G10H 7/00; G10H 1/08

[52] U.S. Cl. ..... 84/609; 84/625; 84/634; 84/601

[58] Field of Search ..... 84/600-602, 84/609-611, 625, 634, 635, 650, 651, 660

[56] References Cited

U.S. PATENT DOCUMENTS 3,877,338 4/1975 David ..... 84/453
4,546,687 10/1985 Minami ..... 84/DIG. 29 X
4,624,171 11/1986 Yuzawa et al. ..... 84/DIG. 29 X
4,771,671 9/1988 Hoff, Jr. ..... 84/453 X
4,915,001 4/1990 Dillard ..... 84/600
5,054,360 10/1991 Lisle et al. ..... 84/645
5,092,216 3/1992 Wadhams ..... 84/602
5,131,311 7/1992 Murakami et al. ..... 84/609

*Primary Examiner*—William M. Shoop, Jr.
*Assistant Examiner*—Jeffrey W. Donels
*Attorney, Agent, or Firm*—Oliff & Berridge

[57] ABSTRACT

A music entertaining device which reproduces music instrumental sound and back chorus so that an entertainer can sing a song to the accompaniment of the reproduced music instrumental sound and the back chorus. The music instrumental data and back chorus data are separately stored in a memory device. Upon detection of a code instructing to insert back chorus during the reproduction of the music instrumental data, a computer base controller accesses the memory device in which the back chorus is stored and reproduces the back chorus identified by the code detected.

20 Claims, 3 Drawing Sheets

MUSIC REPRODUCING DEVICE CAPABLE OF REPRODUCING INSTRUMENTAL SOUND AND VOCAL SOUND

BACKGROUND OF THE INVENTION

The present invention relates to a music reproducing device for reproducing musical instrumental sound and vocal sound on the basis of musical performance data and vocal data.

According to a conventional music reproducing device, musical performance data produced in accordance with a MIDI (musical instrument digital interface) standard is output to an electronic musical instrument such as a synthesizer, electronic piano, rhythm inducing device, etc for reproducing a music by the electronic musical instrument. Further, a so-called Karaoke system has been provided for singing amusement in conformance with the music reproduced by the reproducing device.

In such conventional devices, only the instrumental sound is reproducible, and human vocal sound such as a background chorus can not be reproduced at one time. Therefore, a sound resemblant to the human chorus sound is produced by the electronic musical instrument, and such, electronically composed dummy sound is reproduced for the Karaoke users. However, the dummy sounds lacks realism for the user, and are not sufficiently enjoyable.

SUMMARY OF THE INVENTION

It is therefore an object of the present invention to overcome the above described drawback and deficiency and to provide an improved musical sound reproducing device capable of providing realism in vocal sound such as a background chorus sound.

Another object of the invention is to provide such device provided with a vocal sound reproducing means capable of reproducing a vocal sound based on vocal data which has been digitally coded.

Still another object of the invention is to provide such music reproducing device produced at low cost with reduced memory capacity by reduction in vocal data amount.

These and other objects of the invention will be attained by a music reproducing device which comprises (a) storage means for storing music instrumental sound data and voice sound data, both the music instrument sound data and the voice sound data being in the form of a digital signal, the voice sound data being produced based on a human voice sound music instrumental sound reproducing means for reproducing a music instrumental sound in accordance with the music instrumental sound data, (b) voice sound reproducing means for reproducing a voice sound in accordance with the voice sound data, (c) and control means connected to the storage means, the music instrumental sound reproducing means, and the voice sound reproducing means, for reading the music instrumental sound data from the storage means and outputting the music instrument sound data to the music instrumental sound reproducing means, the control means further reading the voice sound data from the storage means at a predetermined timing during reading of the music instrumental sound data and outputting the voice sound data to the voice sound reproducing means.

The music instrumental sound data contains appointment data, and the voice sound data contains a plurality of phrases of voice sound and phrase number data for identifying each of the plurality of phrases. The appointment data and the phrase number data are correlated to each other. When the control means reads the appointment data, the control means reads one of the plurality of phrases identified by the phrase number data corresponding to the appointment data read by the control means.

With the structure thus organized, reproduction of the musical instrumental sound based on the musical instrumental sound data can be realized concurrently with the reproduction of the vocal sound based on the voice sound data which actual singing voice is digitally coded.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

A music reproducing device according to one embodiment of the present invention will be described with reference to the accompanying drawings.

Figure 1:
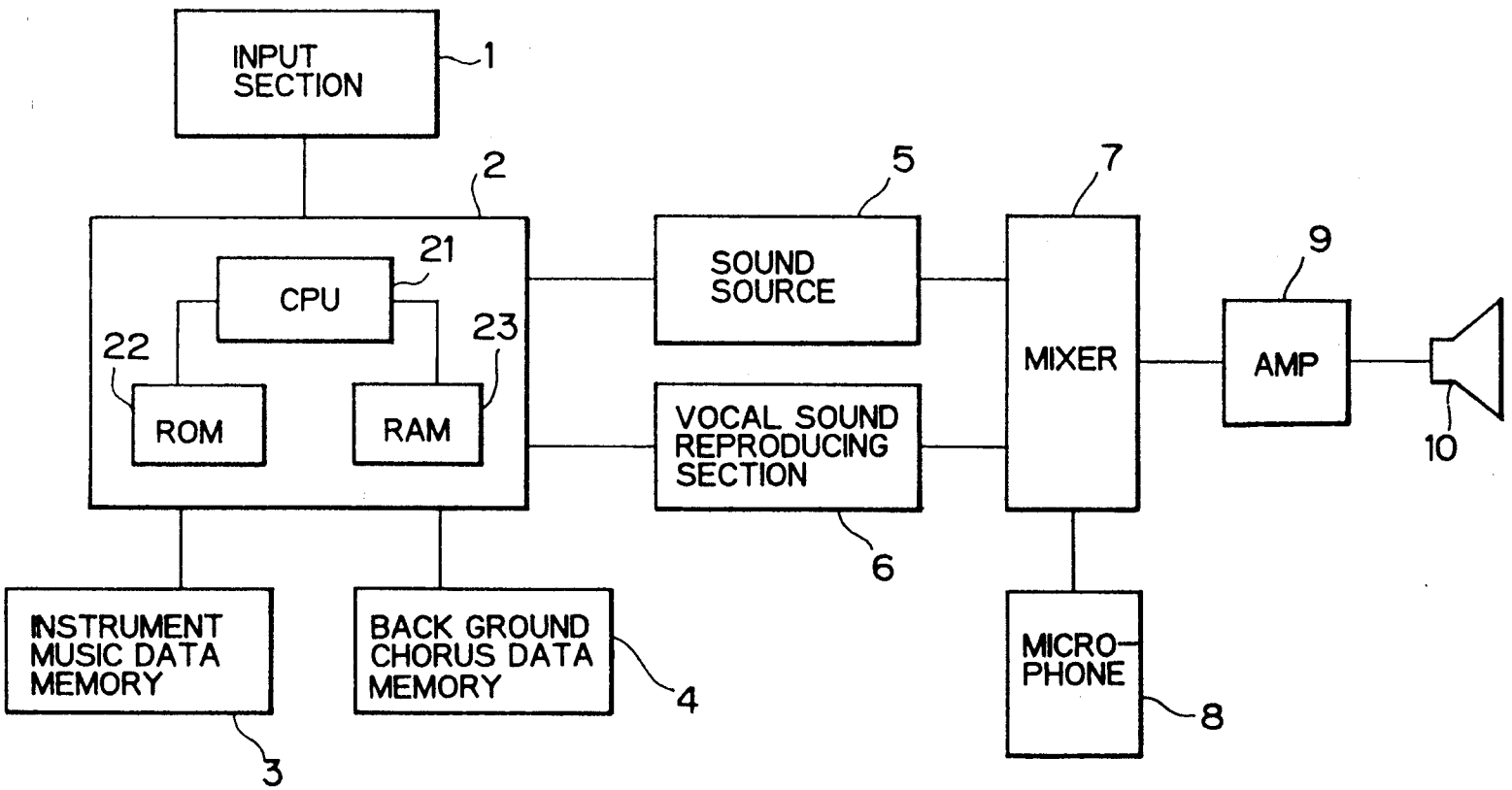
FIG. 1 is a block diagram showing an electric arrangement of a Karaoke system to which a music reproducing device according to one embodiment of this invention is applied.

In FIG. 1, the device is embodied as a Karaoke system. The Karaoke system includes an input section 1, a controller 2, an instrumental music data memory 3, a background chorus data memory 4, a sound source 5, vocal sound reproducing section 6, a mixer 7, a microphone 8, an amplifier 9 and a speaker 10. To the controller 2, the input section 1, the instrumental music data memory 3 and the back chorus data memory 4 are connected. Further, input terminals of the sound source 5 and the vocal sound reproducing section 6 are connected to the controller 2. The mixer 7 has input terminals connected to the microphone 8 and output terminals of the sound source 5 and the vocal sound reproducing section 6. The mixer 7 has an output terminal connected to the speaker 10 through the amplifier 9.

Figure 2:
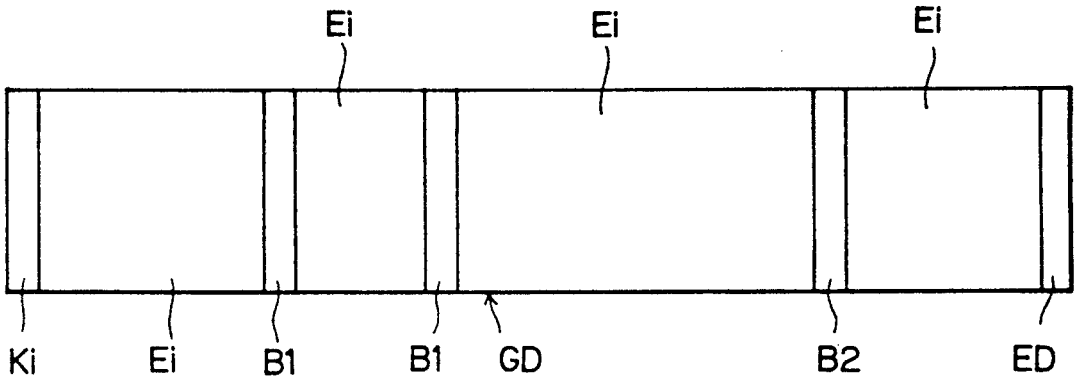
FIG. 2 is a view for description of an arrangement of instrumental data array.

The instrumental music data memory 3 is constituted by a storage device having a large storage capacity, such as an optical memory device. In the music data memory 3, stored are music data GD for reproducing a plurality of pieces of music. As shown in FIG. 2, each of the music data GD contains music number data Ki ($i=1, 2, 3, \ldots$), instrumental data Ei ($i=1, 2, 3, \ldots$), background chorus start data Bi ($i=1, 2, 3, \ldots$) and end data ED. The music number data Ki is provided for identification of each music data GD. The instrument data Ei is produced in accordance with the MIDI standard, and is arranged in time sequence for reproducing instrumental sound. The background chorus start data Bi is insertedly positioned ahead of the succeeding instrument data Ei at a position corresponding to an appropriate background chorus start timing during the reproduction of the instrumental sound. That is, at the inserted position, the background chorus can be reproduced upon instruction of phrase data Fi stored in the background chorus data memory 4. The end data ED is positioned at the end of the music data GD for the indication of an end of the music data GD.

Figure 3:
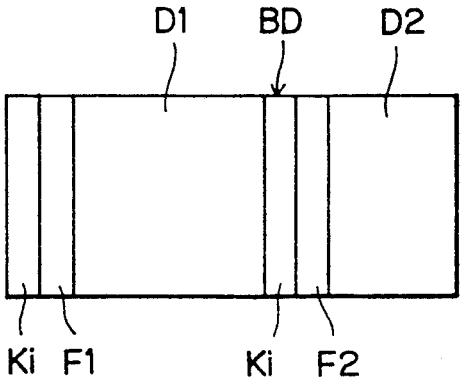
FIG. 3 is a view for description of an arrangement of background chorus or vocal data array.

The background chorus data memory 4 stores therein the backgroung chorus data BD in order to reproduce the background chorus to be inserted in each piece of the music as an insertion phrase or episode. As shown in FIG. 3, the background chorus data BD contains music number data Ki which correspond to the music number data Ki of the music data GD, phrase number data Fi (i=1, 2, 3, . . . ) and chorus data Di (i=1, 2, 3, . . . ). The music number data Ki in the background chorus data BD is the same as the music number data Ki in the music data GD with respect to the identical music. The phrase number data Fi is used for the identification of the chorus data Di. The chorus data Di are digitally coded data produced by the conversion of actual singers' chorus sound in the form of analog signals into the digitally coded data by a conventional ADPCM (adaptive differential pulse-code modulation system). The background chorus data memory 4 is constituted by a storage device having a relatively small memory capacity, such as a floppy disc. The above described music data memory 3 and the background chorus data memory 4 serve as a storing means, the background chorus data Di serves as voice sound data, and the background chorus start data Bi serves as appointment data.

The input section 1 is provided with ten-numeral keys for inputting a number corresponding to the music number data Ki in order to reproduce a desired music.

The controller 2 is constituted by a microcomputer including CPU 21, ROM 22 and RAM 23. The controller 2 outputs instrumental sound data Ei corresponding to the music number inputted through the input section 1 to the sound source 5 in accordance with a program (to be described later). The controller 2 also outputs the chorus data Di to the voice sound reproducing section 6. The ROM 22 stores therein various programs such as music reproduction program shown in FIG. 4 for operating the Karaoke system. Further, the RAM 23 stores therein various data generated during operation of the Karaoke system. The controller 2 serves as control means.

The sound source 5 reproduces musical instrumental sound in accordance with the instrumental data Ei which is the MIDI data. Further, the voice sound reproducing section 6 reproduces the background chorus in accordance with the background chorus data Di. The sound source 5 constitutes an instrumental sound reproducing means, and the voice sound reproducing section 6 constitutes a voice sound reproducing means.

The mixer 7 mixes various sounds such as the instrumental sound from the sound source 5, the voice sound from the voice sound reproducing section 6, actual instrumental sound and actual voice sound input through the microphone 8, and outputs these sounds to the amplifier 9. The amplifier 9 electrically amplifies the output sound signals, and transmits the signals to the speaker 10 for sound generation.

Figure 4:
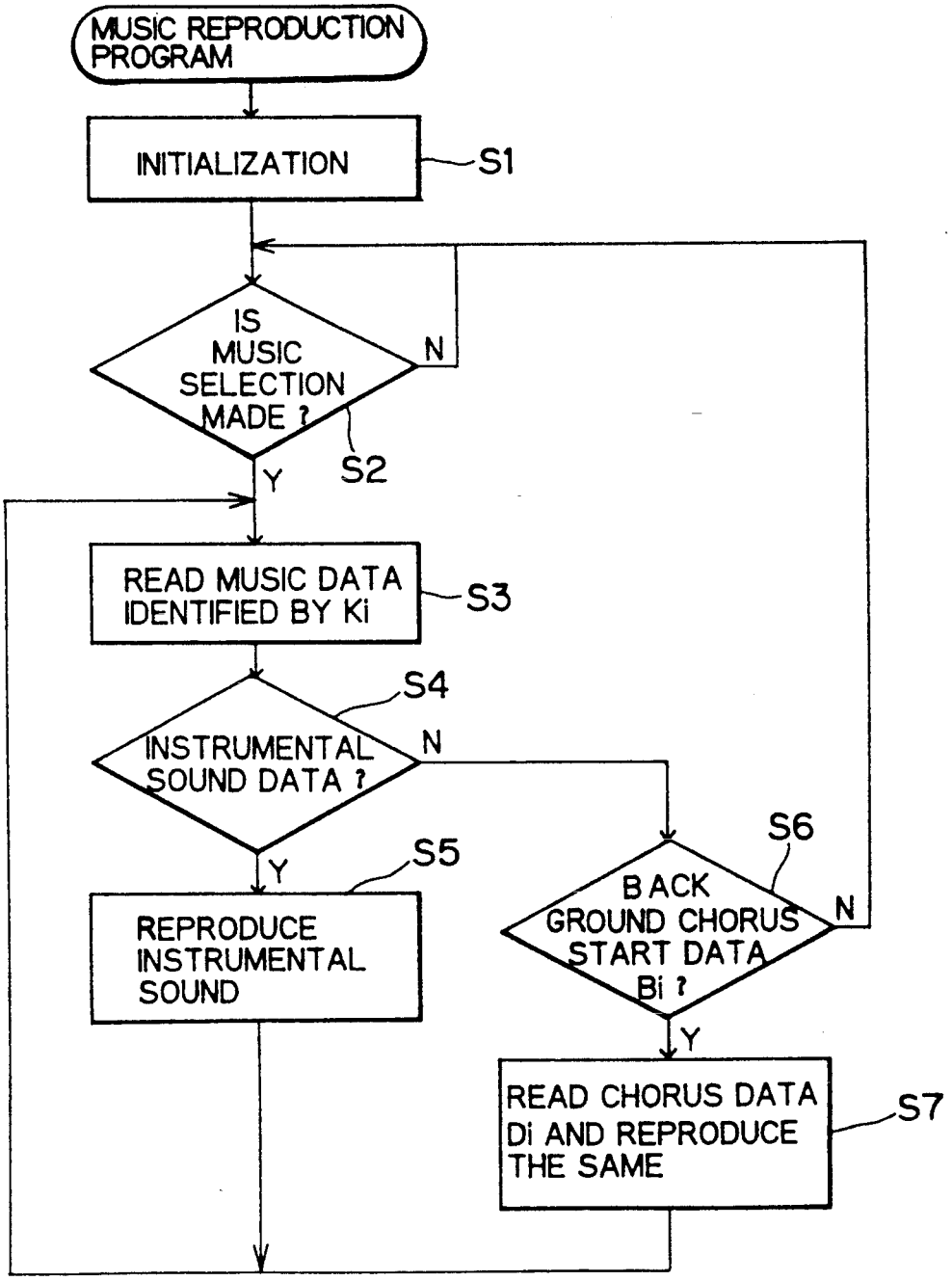
FIG. 4 is a flow chart showing an operation sequence of a Karaoke system.

Operation of the Karaoke system will next be described with reference to the flow chart of FIG. 4.

Upon power supply to the Karaoke system, the CPU 21 of the controller 2 executes the music reproduction program. First, initialization is performed in Step S1 where memory contents in the RAM 23 are erased. Then in Step S2, judgment is made as to whether the music selection is made through the input section 2. If the determination is No, standby phase is maintained. If the user manipulates the input section 2 for selecting desired music (S2:Yes), the routine goes to Step S3 where the music number data Ki is written in the RAM 23 and the music data GD identified by the music number data Ki is read from the music data memory 3. In Step S4, if the retrieved music data GD is the instrumental sound data Ei (S4:Yes), the instrumental data Ei is output to the sound source 5 in Step S5, thereby reproducing the instrumental sound from the speaker 10. However, in Step S4, if the read data GD is not the instrumental sound data (S4: No), the routine proceeds to Step S6 where judgment is made as to whether the read data GD is the back chorus start data Bi. If Yes, the routine goes to Step S7 where the chorus data Di is read from the background chorus data memory 4, which data Di is identified by the music number data Ki stored in the RAM 23 and the phrase data Fi appointed by the background chorus start data Bi. The chorus data Di is thus output to the voice sound reproducing section 6. On the other hand, if the read music data GD is the end data ED (S4: No, S6: No), reproduction of the music is judged to have ended, and the routine returns to Step S2 for maintaining the standby phase in which the input of the second desired music is awaited (S2: No).

The instrumental sound data Ki output in the Step S5 is converted into the instrumental sound at the sound source 5, and the chorus data Di output in the Step S7 is converted into the voice sound at the voice sound reproducing section 6. The instrumental sound and the voice sound are mixed with each other at the mixer 7, and the mixed sound is output from the speaker 10 through the amplifier 9. Thus, a user or an entertainer can sing a song or can play a musical instrument through the microphone 8 in conformance with the thus produced instrumental and chorusing voice sounds, and the user's singing voice is mixed therewith in the mixer 7. The final composite sounds are output from the speaker 10 through the amplifier 9.

More specifically, taken in conjunction with FIGS. 2 and 3, when a user inputs a desired number corresponding to the desired music number data Ki, the music number data Ki is temporarily stored in the RAM 23, and at the same time, the music data GD governed by the music number data Ki is successively read from the music data memory 3. Since, as shown in FIG. 2, the music data GD contains the instrumental sound data Ei at the beginning, the data Ei is output to the sound source 5. The sound source 5 reproduces the instrumental sound in accordance with the instrumental data Ei, and the instrumental sound is generated from the speaker 10 through the mixer 7 and the amplifier 9.

Then, first background chorus start data B1 is read whereupon the music number data Ki stored in the RAM 23 and the chorus data D1 subsequent to the phrase data F1 (FIG. 3) in the background chorus data BD are read from the chorus data memory 4, and the chorus data is output to the voice sound reproducing section 6. The voice sound reproducing section 6 reproduces the background chorus in accordance with the chorus data D1. The thus provided chorus sound and the instrumental sound are mixed with each other in the mixer, and the resultant sound is output from the speaker 10 through the amplifier 9.

Then, a second instrumental data Ei subsequent to the first background chorus start data B1 is output to the sound source 5, and the instrumental sound is generated from the speaker 10 (see Ei of the second occurrence in FIG. 2). Then, when second background chorus data B1 (identical with the first back chorus data B1) is read, the previous chorus data D1 is again read. It should be noted that segmental background chorus sometimes repeat the same phrase. Therefore, the background chorus identical to the previous background chorus is output to the voice sound reproducing section 6, the voice sound is mixed with the instrumental sound, and the mixed sound is emanated from the speaker 10.

Next, when third instrumental sound data Ei subsequent to the second background chorus start data B1 is read, the data is transmitted to the sound source 5 for the reproduction of the instrumental sound in accordance with the instrumental data Ei, and the sound is generated from the speaker 10. Then, if third background chorus data B2 is read, which is different from the first and second background chorus data B1, read from the chorus data memory 4 is the identical music number data Ki and second chorus data D2 shown in FIG. 3 subsequent to second phrase data F2 in the background chorus data BD. The second chorus data D2 is transmitted to the voice sound reproducing section 6. Similarly, a mixed instrumental and background chorus sounds are generated from the speaker 10 upon passing through the mixer 7 and the amplifier 9.

Then, fourth instrumental data Ei is read, and the corresponding instrumental sound is generated from the speaker 10. Thereafter, the end data ED is read whereupon the Karaoke system maintains a standby phase until a next music number is entered. Apparently, during instrumental sound generation or during generation of the mixed instrumental and vocal sounds from the speaker 10, a user can sing a song or can play any music instrument in conformance with the sound. The newly generated sound can also be mixed with the electrically produced sound through the microphone 8 and the mixer 7, and the final composite sound can be generated from the speaker 10.

As described above, in the Karaoke system according to the above described embodiment, the selected music is reproducible with the background chorus whose sound is of perfect reproduction of actual voice sound because of the utilization of the voice sound data produced by the digital coding. Consequently, the user can enjoy audible background chorus sound in addition to the electrical instrumental sound. Further, the identical background chorus phrase is produced by the identical chorus data Di. Therefore, total background chorus data BD can be reduced in quantity in comparison with full data production for the all background chorus parts. Accordingly, storage capacity can be reduced to provide a compact background chorus data memory 4 with low cost.

While the invention has been described in detail and with reference to a specific embodiment thereof, it would be apparent to those skilled in the art that various changes and modifications may be made therein without departing from the spirit and scope of the invention. For example, in the illustrated embodiment, the instrumental sound data memory 3 and the background chorus memory 4 are provided separately. However, these can be provided as a single storing device. Further, for the background chorus coding, a coding system other than ADPCM system is also available. Furthermore, the invention is applied to other type of music reproducing device such as a juke box instead of the Karaoke system, and the voice sound data is used for the reproduction of a vocal solo instead of the background chorus.

What is claimed is:

1. A music reproducing device comprising:

storage means for discretely storing music instrumental sound data and chorus sound data, the music instrumental sound data being in the form of a digital signal providing instructions for instrumentally playing an entirety of a piece of music and including timing information representing a timing at which the chorus sound data are read, the chorus sound data being digitally coded based on a human chorus sound for use in part of the piece of music;

music instrumental sound reproducing means for reproducing a music instrumental sound in accordance with the music instrumental sound data;

voice sound reproducing means for reproducing a voice sound in accordance with the chorus sound data; and control means connected to said storage means, said music instrumental sound reproducing means, and said voice sound reproducing means, for reading the music instrumental sound data from said storage means and outputting the music instrumental sound data to said music instrumental sound reproducing means, said control means further reading the chorus sound data from said storage means at the timing represented by the timing information during reading of the music instrumental sound data and outputting the chorus sound data to said voice sound reproducing means.

2. The device as claimed in claim 1, wherein the music instrumental sound data contains appointment data representing a time of occurrence of said music instrumental sound data, and the chorus sound data contains a plurality of phrases of voice sound and phrase number data for identifying each of the plurality of phrases, each of said phrases corresponding to a piece of music, the appointment data and the phrase number data being correlated to each other in said storage means, and wherein when said control means reads the appointment data, said control means reads one of the plurality of phrases identified by the phrase number data corresponding to the appointment data read by said control means.

3. The device as claimed in claim 2, wherein the music instrumental sound data contains data regarding plural pieces of music instrumental sounds corresponding to a plurality of songs, data regarding each piece of music instrumental sound containing music number data for identifying a song, wherein the chorus sound data are provided in association with the music number data, and wherein when said control means reads the music number data, said control means reads the chorus sound data corresponding to the music number data read by said control means.

4. The device as claimed in claim 3, further comprising inputting means for inputting a music number which specifies one of a plurality of songs, and wherein said control means searches a piece of music instrumental sound based on the music number, the music number corresponding to the music number data.

5. The device as claimed in claim 4, wherein the music instrumental sound data contains end data, and wherein said control means stops reading the music instrumental sound data when the end data are read.

6. The device as claimed in claim 1, further comprising mixing means connected to said music instrumental sound reproducing means and said voice sound reproducing means for mixing the music instrumental sound and the voice sound.

7. The device as claimed in claim 6, further comprising a microphone connected to said mixing means for inputting actual voice sound, said mixing means further mixing the actual voice sound to the music instrumental sound and the voice sound.

8. The device as claimed in claim 1, wherein said storage means comprises first storage means for storing the music instrumental sound data and second storage means for storing the chorus sound data, said first and second storage means being separately provided.

9. A music reproducing device comprising:

storage means for discretely storing music instrumental sound data and chorus sound data, the music instrumental sound data being in the form of a digital signal providing instructions for instrumentally playing an entirety of a piece of music and including at least two timings at which the chorus sound data are read, the chorus sound data being digitally coded based on a human chorus sound for use in part of the piece of music wherein the human chorus sound data includes at least one piece of chorus to be read in conjunction with the piece of music at least two timings included in the music instrumental sound data;

music instrumental sound reproducing means for reproducing a music instrumental sound in accordance with the music instrumental sound data;

voice sound reproducing means for reproducing a voice sound in accordance with the chorus sound data;

control means connected to said storage means, said music instrumental sound reproducing means, and said voice sound reproducing means, for reading the music instrumental sound data from said storage means and outputting the music instrumental sound data to said music instrumental sound reproducing means, said control means further reading the chorus sound data from said storage means at the timing during reading of the music instrumental sound data and outputting the chorus sound data to said voice sound reproducing means;

mixing means connected to said music instrumental sound reproducing means and said voice sound reproducing means for mixing the music instrumental sound and the voice sound; and a microphone connected to said mixing means for inputting actual voice sound, said mixing means further mixing the actual voice sound with the music instrumental sound and the voice sound.

10. The device as claimed in claim 9, wherein the music instrumental sound data contains data regarding plural pieces of music instrumental sounds corresponding to a plurality of songs, data regarding each piece of music instrumental sound containing music number data for identifying a song, wherein the chorus sound data are provided in association with the music number data, and wherein when said control means reads the music number data, said control means reads the chorus sound data corresponding to the music number data read by said control means.

11. The device as claimed in claim 10, further comprising inputting means for inputting a music number which specifies one of a plurality of songs, and wherein said control means searches a piece of music instrumental sound based on the music number, the music number corresponding to the music number data.

12. The device as claimed in claim 11, wherein the music instrumental sound data contains end data, and wherein said control means stops reading the music instrumental sound data when the end data are read.

13. The device as claimed in claim 9, wherein said storage means comprises first storage means for storing the music instrumental sound data and second storage means for storing the chorus sound data, said first and second storage means being separately provided.

14. A music reproducing device comprising:

storage means for discretely storing music instrumental sound data and chorus sound data, the music instrumental sound data being in the form of a digital signal providing instructions for instrumentally playing an entirety of a piece of music, the chorus sound data being digitally coded based on a human chorus sound for use in part of the piece of music;

music instrumental sound reproducing means for reproducing a music instrumental sound in accordance with the music instrumental sound data;

voice sound reproducing means for reproducing a voice sound in accordance with the voice sound data; and control means connected to said storage means, said music instrumental sound reproducing means, and said voice sound reproducing means, for reading the music instrumental sound data from said storage means and outputting the music instrumental sound data to said music instrumental sound reproducing means, said control means further reading the chorus sound data from said storage means at a predetermined timing during reading of the music instrumental sound data and outputting the chorus sound data to said voice sound reproducing means, wherein the music instrumental sound data contains appointment data representing a time of occurrence of said music instrumental sound data, and the chorus sound data contains a plurality of phrases of voice sound and phrase number data for identifying each of the plurality of phrases, each of said phrases corresponding to a piece of music, the appointment data and the phrase number data being correlated to each other in said storage means, and wherein when said control means reads the appointment data, said control means rads one of the plurality of phrases identified by the phrase number data corresponding to the appointment data read by said control means, the piece of music containing at least two timings at which the same phrase is used.

15. The device as claimed in claim 14, wherein the music instrumental sound data contains data regarding plural pieces of music instrumental sounds corresponding to a plurality of songs, data regarding each piece of music instrumental sound containing music number data for identifying a song, wherein the voice sound data are provided in association with the music number data, and wherein when said control means reads the music number data, said control means reads the voice sound data corresponding to the music number data read by said control means.

16. The device as claimed in claim 15, further comprising inputting means for inputting a music number which specifies one of a plurality of songs, and wherein said control means searches a piece of music instrumental sound based on the music number, the music number corresponding to the music number data.

17. The device as claimed in claim 16, wherein the music instrumental sound data contains end data, and wherein said control means stops reading the music instrumental sound data when the end data are read.

18. The device as claimed in claim 14, further comprising mixing means connected to said music instrumental sound reproducing means and said voice sound reproducing means for mixing the music instrumental sound and the voice sound.

19. The device as claimed in claim 18, further comprising a microphone connected to said mixing means for inputting actual voice sound, said mixing means further mixing the actual voice sound to the music instrumental sound and the voice sound.

20. The device as claimed in claim 14, wherein said storage means comprises first storage means for storing the music instrumental sound data and second storage means for storing the voice sound data, said first and second storage means being separately provided.

* * * * *